United States Patent [19]

Idota et al.

[11] Patent Number: 4,798,779

[45] Date of Patent: Jan. 17, 1989

[54] PROCESS FOR FORMING AN IMAGE BY SILVER SALT DIFFUSION TRANSFER

[75] Inventors: Yoshio Idota; Yukio Karino; Hiroshi Hayashi; Hideki Tomiyama, All of Kanagawa, Japan

[73] Assignee: Fuji Photo Film Co., Ltd., Kanagawa, Japan

[21] Appl. No.: 8,452

[22] Filed: Jan. 29, 1987

[30] Foreign Application Priority Data

Jan. 30, 1986 [JP] Japan ..... 61-18400

[51] Int. Cl.[4] ..... G03C 5/54

[52] U.S. Cl. ..... 430/202; 430/231; 430/234; 430/247; 430/249; 430/436; 430/480

[58] Field of Search ..... 430/202, 247, 249, 231, 430/234, 436, 480

[56] References Cited

U.S. PATENT DOCUMENTS

| | | | |
|---|---|---|---|
| 2,774,667 | 7/1951 | Land et al. | 430/247 |
| 3,630,734 | 12/1971 | Cottingham | 430/249 |
| 3,870,479 | 3/1975 | Kubotera et al. | 430/249 |
| 4,626,495 | 12/1986 | Sakaguchi | 430/232 |
| 4,659,646 | 4/1987 | Inoue | 430/230 |

FOREIGN PATENT DOCUMENTS

| | | | |
|---|---|---|---|
| 745103 | 10/1966 | Canada | 430/249 |
| 1003783 | 7/1962 | United Kingdom | 430/234 |
| 1410515 | 10/1975 | United Kingdom | 430/249 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A process for forming an image by silver salt diffusion transfer comprising developing a light-sensitive element which comprises a support having provided thereon a light-sensitive silver halide emulsion layer which has been imagewise exposed to light by an alkaline processing composition in the presence of a silver halide solvent so that at least a part of silver halide unexposed in said emulsion layer is converted to a transferable silver complex salt, and then transferring at least a part of said silver complex salt to an image-receiving layer containing a silver precipitating agent to form an image on said image-receiving layer, wherein the concentration of said silver precipitating agent in said image-receiving layer is in the range of from $2\times10^{-6}$ to $8\times10^{-6}$ mol/m$^2$ and at least one of said light-sensitive element and said alkaline processing composition contains at least one of a compound represented by formula (I) and a compound represented by formula (II)

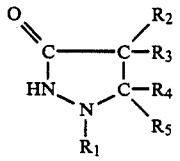

(I)

wherein $R_1$ represents a phenyl group or a phenyl group substituted by an alkyl group having 1 or 2 carbon atoms; $R_2$ and $R_3$ each represents a hydrogen atom, an alkyl group having from 1 to 3 carbon atoms, or a hydroxyalkyl group having from 1 to 3 carbon atoms; and $R_4$ and $R_5$ each represents a hydrogen atom, an alkyl group having from 1 to 3 carbon atoms, a phenyl group, a phenyl group substituted by an alkyl group having from 1 to 3 carbon atoms;

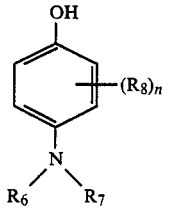

(II)

wherein $R_6$ and $R_7$ each represents a hydrogen atom or an alkyl group having from 1 to 3 carbon atoms; $R_8$ represents an alkyl group having from 1 to 4 carbon atoms; and n represents an integer of from 1 to 3.

11 Claims, No Drawings

PROCESS FOR FORMING AN IMAGE BY SILVER SALT DIFFUSION TRANSFER

FIELD OF THE INVENTION

The present invention relates to a process for forming an image by silver salt diffusion transfer and a film unit for use in the process.

BACKGROUND OF THE INVENTION

A process for forming an image by diffusion transfer of a silver salt such as silver halide is well known. Particularly, the process for forming an image comprises processing a light-sensitive silver halide emulsion layer which has been imagewise exposed to light with an alkaline aqueous solution containing a developing agent, a silver halide solvent, and a film forming agent (thickening agent) so that the silver halide particles thus exposed are reduced to silver by the developing agent while the silver halide particles unexposed are converted to transferable silver complex salt by the silver halide solvent, and then diffusion-transferring the silver complex salt to a silver precipitating agent-containing layer (image-receiving layer) on which the emulsion layer is superimposed by imbibition so that the silver complex salt is reduced by means of the silver precipitating agent to obtain a silver image.

When this process is carried out, a film unit having a combination of a light-sensitive element comprising a light-sensitive silver halide emulsion layer normally disposed on a support, an image-receiving element comprising a silver precipitating agent-containing image-receiving layer disposed on a support, and a processing element comprising a rupturable container containing an active alkaline aqueous solution containing a developing agent, a silver halide solvent, and a film-forming agent is used. After the emulsion layer of the light-sensitive element is imagewise exposed to light, such a film unit is allowed to pass between a pair of rollers in such a manner that the light-sensitive element and the image-receiving element are superimposed on each other with the emulsion layer and the image-receiving layer of the image-receiving element opposed to each other so that the container containing an active alkaline aqueous solution is ruptured and a viscous alkaline aqueous solution is spread over therebetween. After the film unit is allowed to stand for a predetermined period of time, the image-receiving element is peeled off the light-sensitive element so that a print having a desired image formed on the image-receiving layer can be obtained.

In such a diffusion transfer process, "whiteness", which is an important factor for improvement in the picture quality of the print, tends to be lowered as the concentration of a silver precipitating agent in the image-receiving layer is increased. Such a silver precipitating agent preferably has a small particle size (about 20 Å) and hence has a large surface area so that silver produced by the reduction of the silver complex salt can be easily precipitated. However, since a silver precipitating agent is unstable in such small particle size, nuclei of the particles are agglomerated by a weak force (i.e., an aggregation force such as electrostatic force, van der Waals force, etc.) to form particles of larger sizes. When such a silver precipitating agent is coated on an image-receivigg layer, it is colored brown. The brown color density can be lowered by reducing the concentration of the silver precipitating agent. However, this slows the formation of an image or restricts the maximum density. In order to solve such a problem, a fluorescent whitening agent is often used. However, the higher the concentration of the fluorescent whitening agent is, the more is stressed undesirable "paleness". The reduction of the concentration of the precipitating agent also causes the color tone of the image to be cold.

SUMMARY OF THE INVENTION

Therefore, an object of the present invention is to provide a novel image formation process by silver salt diffusion transfer.

It is another object of the present invention to provide a process for increasing the "whiteness" of a print without slowing the formation of an image, reducing the maximum density, or rendering the color tone of an image cold.

These and other objects of the present invention will become more apparent from the following detailed description and examples.

These objects of the present invention are accomplished with a process for forming an image by silver salt diffusion transfer comprising developing a light-sensitive element which comprises a support having provided thereon a light-sensitive silver halide emulsion layer which has been imagewise exposed to light by an alkaline processing composition in the presence of a silver halide solvent so that at least a part of silver halide unexposed in the emulsion layer is converted to a transferable silver complex salt, and then transferring at least a part of the silver complex salt to an imagereceiving layer containing a silver precipitating agent to form an image on the image-receiving layer, wherein the concentration of the silver precipitating agent in the image-receiving layer is in the range of from $2\times10^{-6}$ to $8\times10^{-6}$ mol/m$^2$ and at least one of the light-sensitive element and the alkaline processing composition contains at least one of a compound represented by formula (I) and a compound represented by formula (II)

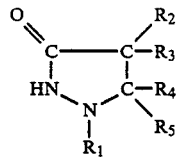

(I)

wherein $R_1$ represetts a phenyl group or a phenyl group substituted by an alkyl group having 1 or 2 carbon atoms; $R_2$ and $R_3$ (which may be the same or different) each represents a hydrogen atom, an alkyl group having from 1 to 3 carbon atoms, or a hydroxyalkyl group having from 1 to 3 carbon atoms; and $R_4$ and $R_5$ (which may be the same or different) each represents a hydrogen atom, an alkyl group having from 1 to 3 carbon atoms, a phenyl group, a phenyl group substituted by an alkyl group having from 1 to 3 carbon atoms;

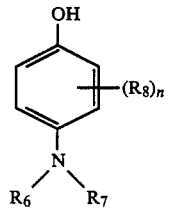

(II)

wherein $R_6$ and $R_7$ (which may be the same or different) each represents a hydrogen atom or an alkyl group having from 1 to 3 carbon atoms; $R_8$ represents an alkyl group having from 1 to 4 carbon atoms; and n represents an integer of from 1 to 3. When n is 2 or 3, plural $R_8$ may be the same or different.

DETAILED DESCRIPTION OF THE INVENTION

In the present invention, the light-sensitive silver halide emulsion layer and the image-receiving layer are provided on the same support or on different supports. Preferably, they are provided on different supports.

The concentration of silver precipitating agent is particularly preferably in the range of from $3\times10^{-6}$ to $7\times10^{-6}$ mol/m$^2$.

As a developing agent for the process for forming an image of the present invention, a hydroxylamine developing agent described hereinafter is preferably used. A preferred embodiment of the present invention is a process which comprises forming an image in the presence of such a hydroxylamine developing agent and at least one of a compound represented by formula (I) and a compound represented by formula (II).

A particularly preferred embodiment is such that the hydroxylamine developing agent, and at least one of a compound represented by formula (I) and a compound represented by formula (II) are contained in the alkaline processing composition.

The amount of at least one of a compound represented by formula (I) and a compound represented by formula (II) is preferably in the range of from $2\times10^{-5}$ to $5\times10^{-3}$ mol, more preferably from $3\times10^{-5}$ to $4\times10^{-3}$ mol, and particularly preferably from $4\times10^{-5}$ to $2\times10^{-3}$ mol, per 100 g of the processing composition.

The amount of the hydroxylamine developing agent to be used per unit area of the light-sensitive element is preferably in the range of from $1\times10^{-8}$ to $1\times10^{-4}$ mol/m$^2$, and particularly preferably from $1\times10^{-7}$ to $1\times10^{-5}$ mol/m$^2$.

It is well known that when a 1-aryl-3pyrazolidone compound or p-aminophenol compound of the present invention is present with hydroquinone, p-phenylenediamine or hydroxylamine, the development is generally accelerated, raising the maximum density. In a process for forming an image by silver salt diffusion transfer, the development can be accelerated even in a physical development, raising the maximum density. However, if the physical development is conducted prior to the diffusion of a silver complex salt in the image-receiving layer, silver thus reduced appears on the surface of the image-receiving layer, giving a metallic sheen to the print.

It has been found that when the concentration of the silver precipitating agent in the image-receiving layer is $8\times10^{-6}$ mol/m$^2$ or less, the print has little metallic sheen.

Surprisingly, the use of a 1-aryl-3-pyrazoline compound or p-aminophenyl compound of the present invention renders the color tone of an image warm.

As mentioned above, the process for increasing the "whiteness" of a print without slowing the formation of an image, lowering the maximum density, rendering the color tone of an image cold, or resulting in the formation of a metallic sheen can be accomplished by forming an image in the presence of at least one of a 1-aryl-3-pyrazolidone compound and a p-aminophenol compound of the present invention with the concentration of a precipitating agent in the image-receiving layer in the range of from $2\times10^{-6}$ to $8\times10^{-6}$ mol/m$^2$ Examples of compounds of formulae (I) and (II) used in the present invention are set forth below, but the present invention should not be construed as being limited thereto.

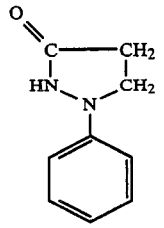
(1)

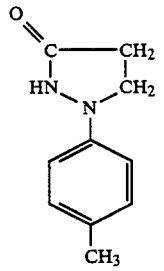
(2)

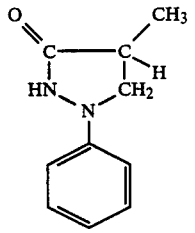
(3)

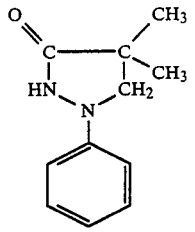
(4)

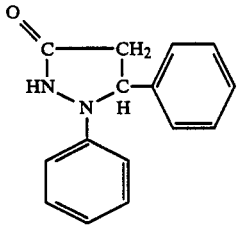
(5)

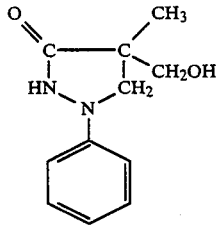
(6)

-continued (7)

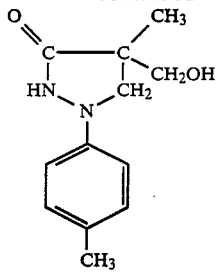

(8)

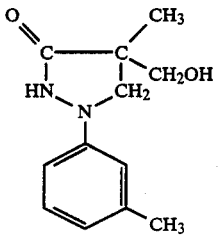

(9)

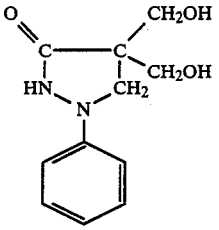

(10)

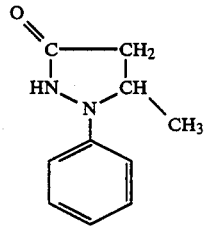

(11)

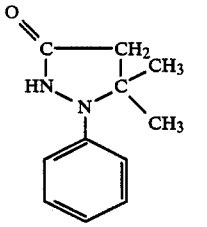

(12)

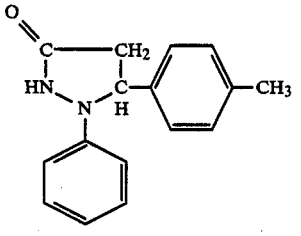

(13)

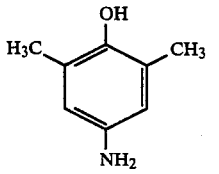

-continued (14)

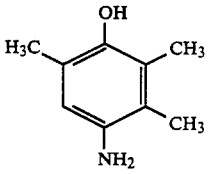

(15)

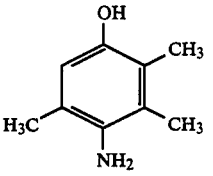

(16)

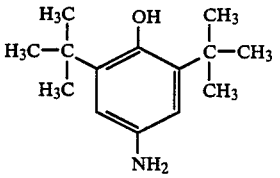

(17)

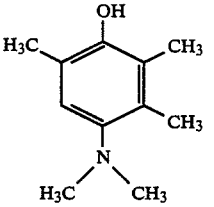

(18)

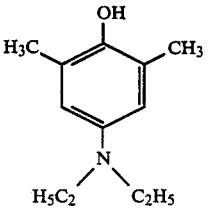

Examples of such a silver precipitating agent include heavy metals such as iron, lead, zinc, nickel, cadmium, tin, chromium, copper and cobalt, particularly noble metals such as gold, silver, platinum and palladium. Examples of other useful silver precipitating agents include sulfides and selenides of heavy metals, particularly sulfides of mercury, copper, aluminum, zinc, cadmium, cobalt, nickel, silver, lead, antimony, bismuth, cerium, magnesium, gold, platinum and palladium, and selenides of lead, zinc, antimony and nickel.

Particularly, gold, platinum, palladium or sulfides thereof are preferably used.

In the process for forming an image and film unit of the present invention, the developing agent may be present in the light-sensitive element or the processing composition element. Preferably, the developing agent is contained in the processing composition. As the developing agent, hydroquinone, tertiary butyl hydroquinone, or benzene or naphthalene compound having a hydroxyl group in the para- or orhto-position may be used.

As the developing agent, preferably used is reductic acid as described in U.S. Pat. No. 3,615,440, or $\alpha,\beta$-endiol as described in U.S. Pat. No. 3,730,716. Particularly preferably used is a hydroxylamine developing agent as described in U.S. Pat. Nos. 3,287,125 and 3,293,034.

The amount of the developing agent to be used is preferably from 0.1 to 40 g, and more preferably from 1 to 20 g, per 100 g of the processing composition.

The silver halide solvent may be present in at least one of the processing element, the light-sensitive element, and the image-receiving element. The silver halide solvent is preferably present in the processing element. As such a silver halide solvent, preferably used are cyclic compounds as described in U.S. Pat. Nos. 2,857,274, 2,857,275 and 2,857,276. Particularly preferred among these compounds are uracil, urasol and 6-methyl uracil.

Further preferred silver halide solvents that may be used include thiosulfates of alkali metals, particularly sodium and potassium is more preferred. Also, disulfonylmethane compounds as described in U.S. Pat. Nos. 3,958,992, 3,976,647, 4,009,167, 4,032,538, 4,046,568, 4,047,954, 4,047,955, and 4,107,176, and Japanese Patent Application (OPI) No. 330/72 (the term (OPI) as used herein refers to a "published unexamined Japanese patent application"); dihydroxypyrimidine compounds containing thioether groups as described in U.S. Pat. Nos. 4,126,459, 4,150,228, 4,211,559 and 4,211,562; and aminothioethers as described in U.S. Pat. Nos. 4,251,617, 4,267,254 and 4,267,256 can be preferably used. These compounds may be used singly or in combination. If such a silver halide solvent is used in combination with two or more of cyclic imide compound and a dihydroxypyrimidine compound containing a thioether group, it is advantageous in that no white crystals are formed on the surface of a print even if the print is stored for a long period of time.

The amount of the silver halide solvent added is preferably from 0.1 to 30 g, and more preferably 0.5 to 10 g, per 100 g of the alkaline processing composition. The processing composition may further contain other auxiliary agents known in the silver salt diffusion transfer process, such as an antifoggant, a toning agent, and a stabilizing agent. In particular, an oxyethylamino compound such as triethanolamine may be advantageously contained in the processing composition because it can prolong the shelf life of the processing solution as described in U.S. Pat. No. 3,619,189.

Such a processing composition as described above is preferably contained in a rupturable container to form a processing element. As such a rupturable container and its material, any known container and material can be used. Specific examples of such a container and material are described in U.S. Pat. Nos. 3,056,491, 3,056,492, 3,173,580, 3,750,907, 3,833,381, 4,303,750 and 4,303,751.

In the present invention, the image-receiving element preferably comprises a support carrying an imagereceiving layer containing a silver precipitating agent, such as baryta paper, cellulose triacetate, and polyester. Such an image-receiving element may be prepared by coating a support which is optionally undercoated (subbed) with a suitable cellulose ester such as cellulose diacetate preferably comprising a silver precipitating agent dispersed therein. The cellulose ester layer thus obtained is then hydrolyzed by an alkali so that at least a part of the depth thereof is converted to cellulose. In a particularly useful example, the portion of the silver precipitating agent layer and/or the underlying cellulose ester layer containing cellulose ester such as cellulose diacetate which is not hydrolyzed contain one or more mercapto compounds which are suitable to improve the color tone or stability of a silver transfer image or other photographic properties. Such a mercapto compound is diffused from the point where it was originally positioned during imbibition. This type of an image-receiving element is described in U.S. Pat. No. 3,607,269.

The image-receiving element preferably contains an image stabilizing layer for improving the image stability. A cationic high molecular weight electrolyte is preferably used as such a stabilizer. In particular, water-dispersed latexes as described in U.S. Pat. No. 3,958,995, and Japanese Patent Application (OPI) Nos. 166940/84, 142339/80, 126027/79, 155835/79, 30328/78 and 92274/79, polyvinyl pyridinium salts as described in U.S. Pat. Nos. 2,548,564, 3,148,061 and 3,756,814, water-soluble quaternary ammonium salt polymers as described in U.S. Pat. No. 3,709,690, and water-insoluble quaternary ammonium salt polymers as described in U.S. Pat. No. 3,898,088 are preferably used.

As a binder for the image stabilizing layer, cellulose acetate is preferably used, particularly preferably cellulose acetate having an acetylation degree of from 40 to 49%.

An intermediate layer is preferably disposed interposed between the image-receiving layer and the layer containing a toning agent or stabilizer. As a material for the intermediate layer, gum arabic, polyvinyl alcohol, or polyacrylamide is preferably used.

The image-receiving layer is preferably provided with a peeling layer on the surface thereof to prevent the processing solution from being attached thereto when the upper layer is peeled off after the processing solution is spread thereover. Preferable as a material for the peeling layer is a compound as described in U.S. Pat. Nos. 3,772,024 and 3,820,999 and British Pat. No. 1,360,653 as well as gum arabic, hydroxyethyl cellulose, methyl cellulose, polyvinyl alcohol, polyacrylamide and sodium alginate.

In other embodiment of the present invention, the image-receiving layer may be incorporated in a light-sensitive element described hereinafter. One of preferred examples is an arrangement comprising a polyethylene terephthalate sheet having an image-receiving layer containing a silver precipitating agent, a light-reflecting layer containing a white pigment such as titanium dioxide, a light-shielding layer containing a light-absorbing material such as carbon black, and a light-sensitive silver halide emulsion layer coated thereon, in the order listed. In such an embodiment, even if the light-sensitive silver halide emulsion layer is not peeled off after diffusion transfer, the background layer can be screened by the light-reflecting layer. Therefore, an image formed on the image-receiving layer can be observed through the polyethylene terephthalate sheet.

Furthermore, in the present invention, a light-sensitive element obtained by coating a light-sensitive silver halide emulsion on a support is preferably used.

As the present light-sensitive silver halide emulsion, any of silver bromide, silver iodobromide, silver iodochlorobromide, silver chlorobromide, and silver chloride may be used. One of preferred silver halides is silver iodobromide or silver iodochlorobromide containing 10 mol% or less of silver iodide. A particularly preferred example of silver halide is silver iodobromide containing from 3 to 10 mol% of silver iodide.

The average particle size of the silver halide particles in the light-sensitive emulsion (represented in terms of particle diameter if the particles are substantially spherical, or edge length if the particles are cubic; values obtained from projected area are averaged) is not specifically limited, but is preferably 3 μm or less, more preferably 1.5 μm or less, and most preferably from 0.8 to 1.2 μm.

The particle size distribution may be either narrow or wide.

The silver halide particles in the light-sensitive emulsion may be in the form of a cubic crystal system, such as cubic and octahedral, irregular shaped crystals, such as spherical and plate-like (tabular), or a composite thereof. Alternatively, the silver halide particles may be in the form of a mixture of various crystal shapes.

The silver halide particles may be constructed such that the inner layer and the surface layer are different in phase or uniform in phase. The silver halide particles may be such that a latent image is formed mainly on the surface thereof or inside thereof. The former silver halide particles are preferably used.

The thickness of the light-sensitive emulsion layer is generally from 0.5 to 8.0 μm, and preferably from 0.6 to 6.0 μm. The amount of the silver halide particles coated on the support is generally from 0.1 to 3 g/m$^2$, and preferably from 0.2 to 1.5 g/m$^2$.

The present light-sensitive emulsion may be prepared in the ordinary manner as used in the preparation of a silver halide photographic emulsion. The light-sensitive emulsion is optionally subjected to chemical sensitization or spectral sensitization. The present emulsion may comprise a fog inhibitor, stabilizer, hardener, coating assistant, antistatic agent, etc. The emulsion may also comprise a vehicle such as gelatin.

The present photographic material may be imagewise exposed to light in a manner commonly used in this field of art. That is, any known suitable light source such as natural light (sunlight), tungsten lamp, fluorescent lamp, mercury vapor lamp, xenon arc lamp, carbon arc lamp, xenon flash lamp, and cathode ray tube flying spot may be used. The exposure can generally be accomplished in 1/1,000 to 1 second, which is a range used by conventional camera. Furthermore, the exposure can be accomplished in an even shorter period of time, e.g., 1/10$^4$ to 1/10$^6$ second in the case where a xenon flash lamp or cathode ray tube is used as a light source. The exposure can also be for an even longer period of time, e.g., longer than 1 second. The spectral composition of the light to be used for exposure may be optionally adjusted by means of a color filter. Alternatively, a laser light may be used for exposure. Furthermore, a light emitted from a fluorescent substance excited by electron rays, X-rays, γ-rays, α-rays, or the like may be used for exposure.

Examples of the above mentioned process for arranging and combining a light-sensitive element, an image-receiving element, and a processing element into a film unit are described in *Neblette's Handbook of Photography and Reprograohy,* edited by Sturge, 7th Ed., 1977, pp. 282 to 285. Particularly preferred examples of such processes are described in detail in U.S. Pat. No. 3,350,991.

The present invention may be applied to an integrated molded type film unit as well as a film unit of a type such that an image-receiving element and a light-sensitive element are peeled apart from each other.

The present invention will be further illustrated in the following examples, but the present invention should not be construed as being limited thereto.

EXAMPLE 1

Light-Sensitive Sheet

Silver halide particles were formed by a single jet process. The silver halide particles thus formed were subjected to physical ripening, desalting, and chemical ripening in the conventional manner to obtain a silver iodobromide emulsion containing 5.5 mol% of iodide. The average diameter of the silver halide particles contained in the emulsion thus obtained was 0.9 μm. 0.65 Mol of a silver halide was contained in 1 kg of the emulsion. The emulsion was then put into pots in an amount of 1 kg each. These pots were allowed to stand in a 50° C. constant temperature bath so that dissolution was completed.

10 ml of a 1 wt % aqueous solution of 3-{5-chloro-2-[2-ethyl-3-(3-ethyl-2-benzothiazolinylidene)propenyl]-3-benzoxazolio}propanesulfonate as an ortho sensitizing dye, 4-{2-[3-ethylbenzothiazoline( 2-ylidene)-2-methyl-1-propenyl]-3-benzothiazolio}butanesulfonate as a panthromatic sensitizing dye, and 4-hydroxy-6-methyl-1,3,3a,7-tetraazaindene, 10 ml of a 1 wt % aqueous solution of 2-hydroxy-4,6-dichlorotriazine sodium salt, 10 ml of a 1 wt % aqueous solution of sodium dodecylbenzenesulfonate, benzenesulfonate, and 10 ml of a 0.1 wt % aqueous solution of lipoic acid were added to the emulsion. The admixture was stirred at a temperature of 40° C. The emulsion thus prepared was coated on an undercoated polyethylene terephthalate film base containing titanium dioxide in an amount such that the thickness of the coating after drying reached 3 μm. The coating was then dried to obtain a desired specimen. A latex of polymethyl methacrylate (average size: 3.5 μm) was added to an aqueous solution of gelatin. The admixture was coated on the above specimen in an amount such that the thickness of the coating after drying reached 1 μm. The amount of silver thus coated was 0.5 g/m$^2$.

Image-Receiving Sheet

A solution of 18 g of cellulose acetate (degree of acetylation: 54%) and 12 g of styrene-maleic anhydride copolymer in 270 ml of acetone and 30 ml of methanol was coated on a polyethylene laminate paper in an amount of 54 ml/m$^2$. The coating was then dried. A mixture of a polymeric compound of the formula shown below and cellulose acetate having a degree of acetylation of 46% was coated on the above coating in amounts of 2 g/m$^2$ and g/m$^2$, respectively. The coating was then dried.

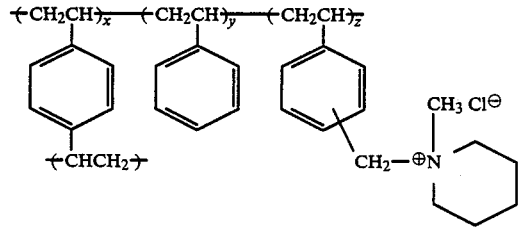

x/y/z = 5/47.5/47.5 (weight ratio)

A 10 % cellulose acetate acetone solution of 3,6-diphenyl-1,4-dimercapto-3H,6H-2,3a,5,6a-tetraazapentalene (0.05 g/m$^2$) was coated on the coating thus dried in an amount such that the thickness of the coating after drying reached 10 g/m$^2$. 5 % Aqueous solution of dimethylolurea and 50% acetic acid were mixed with 5% aqueous solution of polyacrylamide in concentrations of 5% and 1.25%, respectively. The thus obtained solution was coated on the coating in an amount of 25 ml/m$^2$. 3 % Solutions ofcellulose acetate in acetone and methanol (9/1) having silver precipitating agents shown in Table 1 finely dispersed therein were coated on the coating. The coating solution contained 1-phenyl-5-mercapto-imidazole in an amount of $1.25\times10^{-6}$ mol/m$^2$. The thickness of the coating after drying was 0.8 μm. An alkaline solution shown below was coated on the coating thus formed in an amount of 18 ml/m$^2$. The coating was then washed with water and dried to prepare image-receiving sheets.

| | |
|---|---|
| Alkaline Solution: | |
| Potassium Hydroxide (purity: 86%) | 44.3 g |
| Water | 200 ml |
| Methanol | 800 ml |
| Processing Solution: | |
| Potassium Hydroxide (85%) | 260 g |
| Titanium Dioxide | 3 g |
| Uracil | 45 g |
| 6-Methyluracil | 45 g |
| Hydroxyethyl Cellulose | 70 g |
| Zinc Oxide | 10 g |
| N,N—Bismethoxyethylhydroxylamine | 50 g |
| Triethanolamine | 7 g |
| Tetrahydropyrimidinethione | 0.4 g |
| 2,4-Dimercaptopyrimidine | 0.35 g |
| 6-n-Propylthiouracil | 0.35 g |

$2\times10^{-3}$ mol of the compounds shown in Table I were added to portions of the above processing solution. Furthermore, water was added to the admixtures in an amount such that the total amount thereof reached 2 kg. The processing solution thus prepared was spread over between the above mentioned light-sensitive sheet and image-receiving sheet. These sheets were peeled off after 45 seconds for one portion and after 2 minutes for another.

The reflectance, maximum density, relative sensitivity (D=0.6), degree of metallic sheen, and color tone of the specimens were measured at a wavelength of 440 nm. The results are shown in Table 1.

TABLE 1

| Sample No. | Silver Precipitating Agent | Coated Amount (mol/m$^2$) | Compound | Whiteness (%) | Maximum Density | Sensitivity | Metallic Sheen | Tone |
|---|---|---|---|---|---|---|---|---|
| 1 | PdS | $5\times10^{-6}$ | (1) | 80 | 1.78 | 110 | None | Pure black tone |
| 2 | PdS | $5\times10^{-6}$ | (5) | 80 | 1.75 | 110 | None | Pure black tone |
| 3 | PdS | $5\times10^{-6}$ | (6) | 80 | 1.81 | 108 | None | Pure black tone |
| 4 | PdS | $5\times10^{-6}$ | (7) | 80 | 1.80 | 108 | None | Pure black tone |
| 5 | PdS | $5\times10^{-6}$ | (12) | 80 | 1.75 | 110 | None | Pure black tone |
| 6 | PdS | $5\times10^{-6}$ | (13) | 80 | 1.78 | 108 | None | Pure black tone |
| 7 | PdS | $5\times10^{-6}$ | (14) | 80 | 1.80 | 105 | None | Pure black tone |
| 8 | PdS | $5\times10^{-6}$ | (16) | 80 | 1.80 | 105 | None | Pure black tone |
| 9 | PdS | $5\times10^{-6}$ | (17) | 80 | 1.78 | 108 | None | Pure black tone |
| 10 | Pd | $5\times10^{-6}$ | (1) | 80 | 1.75 | 110 | None | Pure black tone |
| 11 | Pd | $5\times10^{-6}$ | (6) | 80 | 1.78 | 110 | None | Pure black tone |
| 12 | Pd | $5\times10^{-6}$ | (7) | 80 | 1.78 | 110 | None | Pure black tone |
| 13 | Pd | $5\times10^{-6}$ | (14) | 80 | 1.78 | 110 | None | Pure black tone |
| 14 | Pd | $5\times10^{-6}$ | (16) | 80 | 1.78 | 110 | None | Pure black tone |
| 15 | Au | $5\times10^{-6}$ | (1) | 80 | 1.75 | 110 | None | Pure black tone |
| 16 | Au | $5\times10^{-6}$ | (14) | 80 | 1.78 | 110 | None | Pure black tone |
| 17 | PdS | $3\times10^{-6}$ | (1) | 83 | 1.68 | 115 | None | Pure black tone |
| 18 | PdS | $3\times10^{-6}$ | (6) | 83 | 1.69 | 115 | None | Pure black tone |
| 19 | PdS | $7\times10^{-6}$ | (1) | 79 | 1.83 | 104 | None | Pure black tone |
| 20 | PdS | $7\times10^{-6}$ | (6) | 79 | 1.83 | 105 | None | Pure black tone |
| 21* | PdS | $1\times10^{-5}$ | | 80 | | | | |
| 22* | PdS | $5\times10^{-6}$ | | 84 | | | | |
| 23 | PdS | $1\times10^{-5}$ | — | 77 | 1.80 | 100 | None | Pure black tone |
| 24 | PdS | $5\times10^{-6}$ | — | 80 | 1.55 | 110 | None | Cold tone |
| 25 | PdS | $1\times10^{-5}$ | (1) | 77 | 1.91 | 95 | Observed | Warm black tone |
| 26 | PdS | $1\times10^{-5}$ | (5) | 77 | 1.85 | 98 | Observed | Warm black tone |
| 27 | PdS | $1\times10^{-5}$ | (6) | 77 | 1.90 | 95 | Observed | Warm black tone |
| 28 | PdS | $1\times10^{-5}$ | (7) | 77 | 1.91 | 95 | Observed | Warm black tone |
| 29 | PdS | $1\times10^{-5}$ | (12) | 77 | 1.85 | 98 | Observed | Warm black tone |
| 30 | PdS | $1\times10^{-5}$ | (13) | 77 | 1.88 | 98 | Observed | Warm black tone |
| 31 | PdS | $1\times10^{-5}$ | (14) | 77 | 1.90 | 94 | Observed | Warm black tone |
| 32 | PdS | $1\times10^{-5}$ | (16) | 77 | 1.90 | 94 | Observed | Warm black tone |
| 33 | PdS | $1\times10^{-5}$ | (17) | 77 | 1.85 | 98 | Observed | Warm black tone |
| 34 | Pd | $1\times10^{-5}$ | (1) | 77 | 1.85 | 97 | Observed | Warm black tone |
| 35 | Pd | $1\times10^{-5}$ | (6) | 77 | 1.88 | 95 | Observed | Warm black tone |
| 36 | Pd | $1\times10^{-5}$ | (7) | 77 | 1.88 | 95 | Observed | Warm black tone |
| 37 | Pd | $1\times10^{-5}$ | (14) | 77 | 1.88 | 95 | Observed | Warm black tone |
| 38 | Pd | $1\times10^{-5}$ | (16) | 77 | 1.88 | 95 | Observed | Warm black tone |
| 39 | Au | $1\times10^{-5}$ | (1) | 77 | 1.85 | 94 | Observed | Warm black tone |
| 40 | Au | $1\times10^{-5}$ | (14) | 77 | 1.88 | 94 | Observed | Warm black tone |
| 41* | PdS | $1\times10^{-6}$ | | 90 | | | | |
| 42* | PdS | $3\times10^{-6}$ | | 86 | | | | |
| 43* | PdS | $7\times10^{-6}$ | | 82 | | | | |
| 44 | PdS | $1\times10^{-6}$ | — | 87 | 1.15 | 130 | None | Cold tone |
| 45 | PdS | $3\times10^{-6}$ | — | 83 | 1.40 | 115 | None | Cold tone |
| 46 | PdS | $7\times10^{-6}$ | — | 79 | 1.68 | 105 | None | Cold tone |
| 47 | PdS | $1\times10^{-6}$ | (1) | 87 | 1.40 | 120 | None | Cold tone |

TABLE 1-continued

| Sample No. | Silver Precipitating Agent | Coated Amount (mol/m²) | Compound | Whiteness (%) | Maximum Density | Sensitivity | Metallic Sheen | Tone |
|---|---|---|---|---|---|---|---|---|
| 48 | PdS | 1* × $10^{-6}$ | (6) | 87 | 1.40 | 122 | None | Cold tone |

*Unprocessed
Note: Sample Nos. 21 to 32, 33 to 40 and 41 to 48 are comparative samples.

From the results shown in Table 1, the present invention can increase the "whiteness" without slowing the formation of an image, reducing the maximum density, resulting in metallic sheen, or rendering the tone cold.

EXAMPLE 2

Compounds shown in Table 2 were added to the light-sensitive element used in Example 1 in an amount of $1\times10^{-6}$ mol/m². The specimens thus prepared were tested in the same manner as used in Example 1.

The processing composition used in Example 2 did not contain a compound according to the present invention.

TABLE 2

| Sample No. | Silver Precipitating Agent | Coated Amount (mol/m²) | Compound | Whiteness (%) | Maximum Density | Sensitivity | Metallic Sheen | Tone |
|---|---|---|---|---|---|---|---|---|
| 49 | PdS | 5 × $10^{-6}$ | (5) | 80 | 1.74 | 110 | None | Pure black tone |
| 50 | PdS | 5 × $10^{-6}$ | (12) | 80 | 1.74 | 110 | None | Pure black tone |
| 51 | PdS | 1 × $10^{-6}$ | (5) | 77 | 1.85 | 100 | None | Warm black tone |
| 52 | PdS | 1 × $10^{-6}$ | (12) | 77 | 1.84 | 100 | None | Warm black tone |

Note: Sample Nos. 51 and 52 are comparative samples.

In accordance with the present invention, if the image-receiving layer contains a silver precipitating agent in an amount of from $2\times10^{-6}$ to $8\times10^{-6}$ mol/m², and at least one of a 1-aryl-3-pyrazolidinone compound and a p-aminophenol compound of the present invention is contained in the light-sensitive element and/or processing composition, the "whiteness" of a print can be increased without slowing the formation of an image, reducing the maximum density, resulting in metallic sheen, or rendering the tone cold.

While the invention has been described in detail and with reference to specific embodiments thereof, it will be apparent to one skilled in the art that various changes and modifications can be made therein without departing from the spirit and scope thereof.

What is claimed is:

1. A process for forming an image by silver salt diffusion transfer comprising developing a light-sensitive element, which element comprises a support having provided thereon a light-sensitive silver halide emulsion layer which has been imagewise exposed to light, by an alkaline processing composition in the presence of a silver halide solvent, so that at least a part of silver halide unexposed in said emulsion layer is converted to a transferable silver complex salt, and then transferring at least a part of said silver complex salt to an image-receiving layer containing a silver precipitating agent to form an image on said imagereceiving layer, wherein the concentration of said silver precipitating agent in said image-receiving layer is in the range of from $2\times10^{-6}$ to $8\times10^{-6}$ mol/m² and at least one of said light-sensitive element and said alkaline processing composition contains at least one of a compound represented by formula (I) or a compound represented by formula (II)

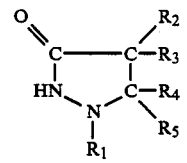

(I)

wherein $R_1$ represents a phenyl group or a phenyl group substituted by an alkyl group having 1 or 2 carbon atoms; $R_2$ and $R_3$ each represents a hydrogen atom, an alkyl group having from 1 to 3 carbon atoms, or a hydroxyalkyl group having from 1 to 3 carbon atoms; and R4 and R5 each represents a hydrogen atom, an alkyl group having from 1 to 3 carbon atoms, a phenyl group, a phenyl group substituted by an alkyl group having from 1 to 3 carbon atoms;

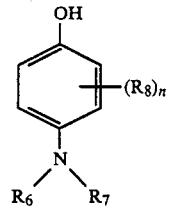

(II)

wherein $R_6$ and $R_7$ each represents a hydrogen atom or an alkyl group having from 1 to 3 carbon atoms; $R_8$ represents an alkyl group having from 1 to 4 carbon atoms; and n represents an integer of from 1 to 3.

2. A process for forming an image as in claim 1, wherein said light-sensitive silver halide emulsion layer and said image-receiving layer are provided on different supports.

3. A process for forming an image as in claim 1, wherein the concentration of said silver precipitating agent is in the range of from $3\times10^{-6}$ to $7\times10^{-6}$ mol/m².

4. A process for forming an image as in claim 1, wherein said alkaline processing composition contains a hydroxylamine developing agent and said at least one of a compound represented by formula (I) or a compound represented by formula (II).

5. A process for forming an image as in claim 1, wherein said at least one of a compound represented by formula (I) or a compound represented by formula (II) is present in an amount of from $2\times10^{-5}$ to $5\times10^{-3}$ mol per 100 g of said alkaline processing composition.

6. A process for forming an image as in claim 5, wherein said at least one of a compound represented by formula (I) or a compound represented by formula (II) is present in an amount of from $3\times10^{-5}$ to $4\times10^{-3}$ mol per 100 g of said alkaline processing composition.

7. A process for forming an image as in claim 6, wherein said at least one of a compound represented by formula (I) or a compound represented by formula (II) is present in an amount of from $4\times10^{-5}$ to $2\times10^{-3}$ mol per 100 g of said alkaline processing composition.

8. A process for forming an image as in claim 1, wherein said at least one of a compound represented by formula (I) or a compound represented by formula (II) is present in an amount of from $1\times10^{-8}$ to $1\times10^{-4}$ mol/m$^2$ of said light-sensitive element.

9. A process for forming an image as in claim 8, wherein said at least one of a compound represented by formula (I) or a compound represented by formula (II) is present in an amount of from $1\times10^{-7}$ to $1\times10^{-5}$ mol/m$^2$ of said light-sensitive element.

10. A process for forming an image as in claim 1, wherein said silver precipitating agent is gold, platinum, palladium, or sulfides thereof.

11. A process for forming an image as in claim 1, weherein said silver halide solvent is present in said alkaline processing composition.

* * * * *